United States Patent [19]

Woodward

[11] 4,173,480

[45] Nov. 6, 1979

[54] PHOTOGRAPHIC SHEET WITH SYNTHETIC HECTORITE ANTISTATIC ADDITIVE AS SIZING OR BACKCOAT

[75] Inventor: Antony I. Woodward, Amersham, England

[73] Assignee: Wiggins Teape Limited, Beaconsfield, England

[21] Appl. No.: 895,480

[22] Filed: Apr. 11, 1978

Related U.S. Application Data

[63] Continuation of Ser. No. 601,426, Aug. 4, 1975, abandoned.

[51] Int. Cl.[2] ..... G03C 1/82; G03C 1/78

[52] U.S. Cl. ..... 430/536; 428/404; 428/407; 428/411; 428/454; 428/913; 428/513; 430/537; 430/635; 430/156; 430/50

[58] Field of Search ..... 428/404, 407, 411, 454, 428/913; 96/85, 87 A, 114.2, 114.5

[56] References Cited

U.S. PATENT DOCUMENTS

| | | | |
|---|---|---|---|
| 3,525,621 | 8/1970 | Miller | 96/85 |
| 3,682,696 | 8/1972 | Yasuda | 428/454 X |
| 3,874,878 | 4/1975 | Rasch et al. | 96/87 A |

*Primary Examiner*—P. C. Ives

*Attorney, Agent, or Firm*—Imirie, Smiley & Guay

[57] ABSTRACT

Sheet material having a polymeric surface for receiving a photographic image, the material comprising an antistatic agent which is a synthetic hectorite clay having a layered structure the layers of which are electrically charged.

10 Claims, 2 Drawing Figures

Figure 1:
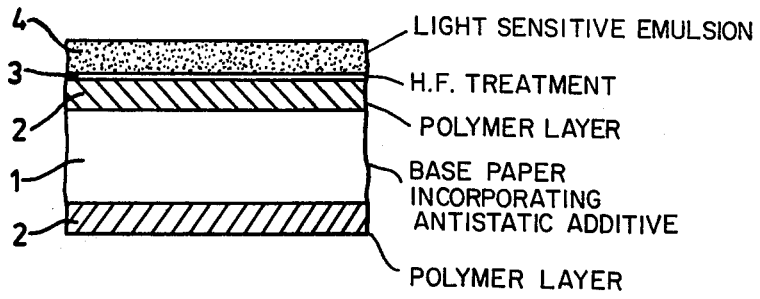

PHOTOGRAPHIC SHEET WITH SYNTHETIC HECTORITE ANTISTATIC ADDITIVE AS SIZING OR BACKCOAT

This is a continuation of application Ser. No. 601,426, filed Aug. 4, 1975 (now abandoned).

This invention relates to antistatically treated polymer coated paper, for receiving a photographic image.

It is well known that undesirable static charges can be produced during handling of paper, and that as a result sparking may occur. The problem of static charges is particularly serious where paper coated with polymers such as polyethylene are concerned, because of the non-conductive nature of these polymers. Since polymer coated paper is used as a photographic base and has therefore to be coated with radiation-sensitive emulsions, sparking is particularly undesirable, since it may lead to fogging. A further problem is that electrostatically charged paper tends to pick up dust and contamination, which not only impairs the appearance of the paper, but also may interfere with the operation of photoelectric control devices, for example devices arranged to detect marks at predetermined locations on the paper for the purpose of chopping prints after final processing and drying stages.

In order to overcome the disadvantages discussed above, the use of various "antistatic agents" has been proposed. The antistatic agents may for example be applied as a coating or additive to raw base paper prior to coating with polymer or as a coating to base paper which has already been polymer coated. The addition of antistatic agents to the polymer prior to coating, which normally involves extrusion of a polymer film, has also been proposed, but has not been found wholly satisfactory, so far as we are aware.

In the manufacture of raw paper base for polymer coating, it has been found desirable to apply a surface size, e.g. gelatine, starch or polyvinyl alcohol, in order to minimise abrasion and to prevent individual fibres lifting from the web during application of an extruded polymer coating to the paper web, which would result in a deterioration in the smoothness and appearance of the polymer coated paper surface. The surface size also has the advantage of increasing the rigidity of the base paper, which assists in preventing resistance to curl in the final processed print.

It would clearly be desirable to carry out the addition of antistatic agent at the same time as surface sizing, which requires that the antistatic agent should be water soluble or dispersible. However, many antistatic agents have the disadvantage that they are incompatible with commonly used film forming agents such as gelatine, for example because they cause flocculation of the film forming agent.

It is desirable for it to be possible to write or print, for example by means of a rubber stamp, on the "back" of photographic base paper, i.e. the surface of the paper which is not subsequently to be coated with photographic emulsion. This is difficult however, in the case of polymer coated papers, which are thus said to have poor "take." Consequently, the use of various backcoats has been proposed, in order to impart an adequate "take" to the paper. It would clearly be desirable for the antistatic agent to be included in such a backcoat. A potential problem which may arise with this procedure is that many antistatic agents are water soluble, and thus tend to be washed off on contact with photographic processing solutions.

It has now been found that certain synthetic hectorite clays are useful as antistatic agents for paper having a polymeric surface for receiving a photographic image, both for application as a constituent of a backcoat and for application to uncoated base paper, for example at a size press.

According to the invention, there is provided sheet material having a polymeric surface for receiving a photographic image, the material comprising an antistatic agent which is a synthetic hectorite clay having a layered structure the layers of which are electrically charged.

The present sheet material may be used as a base for a layer of radiation-sensitive emulsion. Thus the invention also resides in sheet material as defined in the preceding paragraph when coated on a polymeric surface thereof with radiation-sensitive emulsion. The polymeric surface may have been corona discharge treated to enhance the adhesion of the emulsion to the polymeric surface, and a sub-coat may be applied after such treatment to prolong its effects. Corona discharge treatment and the application of such a sub-coat are described in our British Pat. Nos. 1 043 703 and 1 134 211.

The present sheet material may also be used as a substrate for receiving an exposed positive image in the chemical transfer photographic process (this process is well known in the art and so will not be described further herein). A nucleating layer, e.g. of gelatine containing selenium sulphide, zinc sulphide or cadmium sulphide may be applied to the polymeric surface of the present sheet material.

A synthetic hectorite clay is a magnesium silicate lattice structure in which magnesium ions are bound in octahedral relationship with hydroxyl ions, some of which may be replaced by fluorine atoms. The electrical charge may result from various causes, for example substitution of some of the magnesium ions by lithium ions, by the absence of certain magnesium ions from the lattice, and/or by the replacement of some silicon atoms by other atoms for example aluminium, zinc, titanium and/or tin atoms. The electrical charge on the layers is thought to be balanced by exchangeable ions, for example sodium ions disposed between the layers. In aqueous solution, the exchangeable ions are hydrated, leaving the charged layers, which repel one another. A colloidal sol results, which looks and flows like water and which affords a convenient vehicle for applying the antistatic agent to the sheet material.

The sheet material may be a paper base coated on at least one of its surfaces with a layer of a polymer, for example a polyolefin such as polyethylene, in which case the synthetic hectorite clay may be present as a size coating on the paper base. Normally, there is some penetration of the size coating into the base, so that the antistatic agent is not confined to the paper surface. A synthetic hectorite clay, besides having good antistatic properties, also possesses good film forming properties, even when applied very thinly, probably as a consequence of its layered structure, and hence is especially useful in a size composition, since it tends to reduce lifting of fibres from the web and also results in an increase in sheet rigidity. Sodium sulphate, which is also an antistatic agent, may also be present in the size coating.

Alternatively or in addition to being present in a size coating, the synthetic hectorite clay may be present as a constituent of a backcoat on the sheet material. Other constituents of the backcoat may be a colloidal silica or a particulate silica or both. A binder may also be present, for example gelatine, starch or carboxymethylcellulose. Where the back of the sheet material is polymer coated, it is preferable that it be subjected to corona discharge treatment first, in order to enhance the adhesion of the backcoat to the polymeric surface.

As an alternative to the use of a polymer coated paper base, it has been proposed in our copending British patent application No. 47686/74 to use a heat consolidated web made wholly or predominantly from fibres of a synthetic polymer as a sheet material for receiving a photographic image. A synthetic hectorite clay antistatic agent is also suitable for use with such a sheet material, as a constituent of a backcoat on the sheet material, in analogous manner to that described in the preceding paragraph. Again, a corona discharge treatment may be desirable before application of the backcoat.

Figure 2:
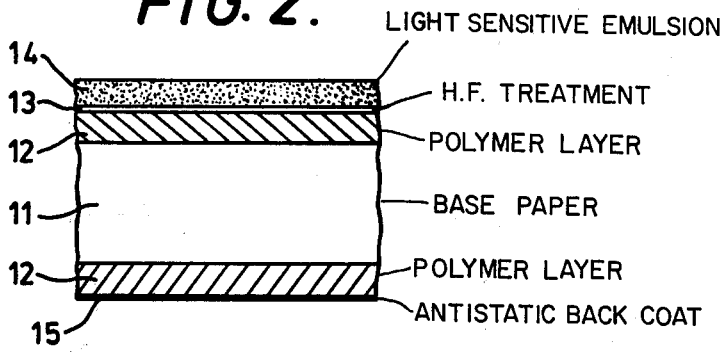

In order to enable the invention to be more readily understood, reference will now be made to the accompanying drawings, which illustrate diagrammatically and by way of example, two embodiments thereof, and in which:

FIG. 1 is a cross-section through a sheet of photographic base paper which has been antistatically treated by sizing; and FIG. 2 is a cross-section through a sheet of photographic base paper which has been antistatically treated by the application of a backcoat.

Referring to FIG. 1, the sheet comprises a base paper 1 which has been surface sized with a size composition containing a synthetic hectorite clay and optionally sodium sulphate as well. The surfaces of the base paper 1 are coated with respective polymer layers 2, for example of polyethylene one of which after being coated has been treated by high frequence corona discharge to produce a modified surface region 3 which is hydrophilic. A sub-coat (not shown) may also be present in order to prolong the effects of the corona discharge treatment, as described, for example, in British Pat. No. 1 134 211. The treated polymer surface is coated with a layer of light sensitive emulsion 4.

Referring to FIG. 2, the sheet comprises a sized paper base 11 the surfaces of which are coated with respective polymer layers 12, for example of polyethylene, one of which after being coated has been treated by high frequency corona discharge to produce a modified surface region 13. The treated polymer surface is coated with a layer of light-sensitive emulsion 14. The surface of the other polymer layer carries a backcoat 15 containing a synthetic hectorite clay, and optionally, a particulate silica and/or colloidal silica. The size for the paper base 11 may be conventional or as described with reference to the layer 1 in FIG. 1. If desired, the polymer layer may be corona discharge treated before application of the backcoat.

The invention will now be illustrated by the following Examples in which all resistivity measurements were made at 50% Relative Humidity:

EXAMPLE I

This Example illustrates the use of a synthetic hectorite clay in a surface sizing composition.

An engine sized photographic base paper of substance 180 g/m$^2$ was surface sized with aqueous compositions containing different amounts of Laponite S, a synthetic hectorite clay sold by Laporte Industries Ltd. The wet coatweight applied was about 10 g/m$^2$. The results of surface and volume resistivity tests carried out using a megohmeter are given in Table I below:

Table I

| % Laponite in Composition Applied | Zero | 0.5 | 1 | 2 | 5 | 10 |
|---|---|---|---|---|---|---|
| Surface Resistivity (Ω/sq) | $1.3 \times 10^{12}$ | $4.2 \times 10^{11}$ | $2.0 \times 10^{11}$ | $9.5 \times 10^{10}$ | $1.2 \times 10^{11}$ | $1.2 \times 10^{11}$ |
| Volume Resistivity (Ω/sq) | $2.1 \times 10^{11}$ | $9.9 \times 10^{10}$ | $4.8 \times 10^{10}$ | $2.4 \times 10^{10}$ | $2.9 \times 10^{10}$ | $4.2 \times 10^{10}$ |

EXAMPLE II

This example illustrates the use of a synthetic hectorite clay in sizing compositions also containing various binders. Results obtained for Kenley rigidity and surface and volume resistivity measurements are given in Table II below. The base paper in each case had been engine sized and had a substance of 180 g/m$^2$. Laponite S at a concentration of 2% was the antistatic agent.

Table II

| Binder Size Mix | Carboxy-methyl-cellulose (0.5%) | Carboxy-methyl-cellulose (1.0%) | Starch (5%) | Starch (10%) | Gelatin (1%) | Gelatin (5%) |
|---|---|---|---|---|---|---|
| Wet Coatweight (g/m$^2$) | 9 | 13 | 17 | 20 | 15 | 25 |
| Surface Resistivity (Ω/sq) | $1.4 \times 10^{11}$ | $1.3 \times 10^{11}$ | $1.2 \times 10^{11}$ | $1.2 \times 10^{11}$ | $2.2 \times 10^{11}$ | $9.1 \times 10^{10}$ |
| Volume Resistivity (Ω/sq) | $5.2 \times 10^{10}$ | $7.4 \times 10^{10}$ | $.8 \times 10^{10}$ | $4.9 \times 10^{10}$ | $1.2 \times 10^{11}$ | $3.6 \times 10^{9}$ |
| Rigidity (Kenley) (cross-direction) (gf) | 1.12 | 1.32 | 1.34 | 1.37 | 1.37 | 1.50 |

It will be seen that the binder used does not greatly affect the resistivity results obtained. In the following Examples therefore, the starch are used as the binder, for reasons of economy (the starch was that sold as Viscosol CS410 by Starch Products Ltd.)

EXAMPLE III

This Example illustrates the use of a size composition containing varying amounts of Laponite S sodium sulphate and a starch binder. The base paper in each case had been engine sized and was of substance 180 g/m$^2$. The starch content is preferably 15%. The size composition was applied in each case at a wet coatweight of about 18 g/m$^2$. The results are given in Table III below:

Table III

| | | | | | | | | |
|---|---|---|---|---|---|---|---|---|
| Size | Laponite | — | — | — | — | — | 1 | 1 |
| Mix | Sodium | ½ | 3 | 5 | 7 | 10 | 5 | 7 |
| Composition | Sulphate | | | | | | | |
| (%) | Starch | 15 | 15 | 15 | 15 | 15 | 15 | 15 |
| Surface Resistivity (Ω/sq) | | $1.7 \times 10^{11}$ | $6.2 \times 10^{10}$ | $2.7 \times 10^{10}$ | $6.5 \times 10^{9}$ | $1.1 \times 10^{10}$ | $1.1 \times 10^{10}$ | $9.5 \times 10^{9}$ |
| Volume Resistivity (Ω/sq) | | $2.9 \times 10^{10}$ | $1.8 \times 10^{10}$ | $5.7 \times 10^{10}$ | $1.9 \times 10^{9}$ | $2.2 \times 10^{10}$ | $2.1 \times 10^{10}$ | $1.2 \times 10^{9}$ |
| Size | Laponite | 1 | 2 | 2 | 2 | 2 | 2 | 2 |
| Mix | Sodium | 10 | — | ½ | 1 | 2 | 3 | 5 |
| Composition | Sulphate | | | | | | | |
| (%) | Starch | 15 | 15 | 15 | 15 | 15 | 15 | 15 |
| Surface Resistivity (Ω/sq) | | $1.0 \times 10^{10}$ | $9.5 \times 10^{11}$ | $1.0 \times 10^{11}$ | $1.1 \times 10^{11}$ | $1.2 \times 10^{11}$ | $4.6 \times 10^{10}$ | $7.1 \times 10^{9}$ |
| Volume Resistivity (Ω/sq) | | $7.5 \times 10^{8}$ | $6.2 \times 10^{10}$ | $2.4 \times 10^{10}$ | $2.3 \times 10^{10}$ | $2.8 \times 10^{10}$ | $1.3 \times 10^{10}$ | $1.5 \times 10^{9}$ |
| Size | Laponite | 2 | 2 | 3 | 5 | 2 | 2 | 2 |
| Mix | Sodium | 7 | 10 | 5 | 5 | 5 | 3 | 5 |
| Composition | Sulphate | | | | | | | |
| (%) | Starch | 15 | 15 | 15 | 15 | 10 | 20 | 20 |
| Surface Resistivity (Ω/sq) | | $6.7 \times 10^{9}$ | $1.0 \times 10^{10}$ | $1.1 \times 10^{10}$ | $1.3 \times 10^{10}$ | $3.1 \times 10^{10}$ | $2.8 \times 10^{10}$ | $2.2 \times 10^{10}$ |
| Volume Resistivity (Ω/sq) | | $1.6 \times 10^{9}$ | $3.6 \times 10^{9}$ | $2.4 \times 10^{9}$ | $3.2 \times 10^{9}$ | $9.2 \times 10^{9}$ | $5 \times 10^{9}$ | $4.5 \times 10^{9}$ |

EXAMPLE IV

This Example illustrates the effect of the solids content of a size coating composition on the surface and volume resistivities and rigidity of the sized paper. The base paper in each case had previously been engine sized and was of substance 180 g/m². The results are given in Table IV below, together with results for a control paper which had not been sized at all.

Table IV

| | | | | | |
|---|---|---|---|---|---|
| Size | % Laponite | 2 | 3 | 4 | |
| Mix | % Sodium Sulphate | 5 | 7½ | 10 | No |
| Composition | % Starch | 15 | 22½ | 30 | Size |
| | % Total Solids | 22 | 33 | 44 | |
| Wet Coatweight (g/m²) | | 17 | 28 | 32 | |
| Surface Resistivity (Ω/sq) | | $7.1 \times 10^{9}$ | $1.4 \times 10^{9}$ | $1.7 \times 10^{9}$ | $1.3 \times 10^{12}$ |
| Volume Resistivity (Ω/sq) | | $1.5 \times 10^{9}$ | $2.2 \times 10^{9}$ | $1.4 \times 10^{9}$ | $2.1 \times 10^{11}$ |
| Rigidity (cross-direction) (Kenley) (gf) | | 1.39 | 1.58 | 1.67 | 0.80 |

EXAMPLE V

This Example illustrates the use of a synthetic hectorite clay in a backcoat composition.

A photographic base paper of substance 180 g/m² was surface sized with a 6% starch size composition and then coated on one side with an extruded film of polyethylene of substance 38 g/m². Various backcoat compositions containing Laponite S were then applied to the coated surface at a wet coatweight of about 12 g/m², and surface resistivity was measured using a megohmeter. The results are given in Table V below:

Table V

| | | | | | | |
|---|---|---|---|---|---|---|
| % Laponite in Backcoat | Zero | 1 | 2 | 4 | 1 | 2 |
| % Colloidal Silica | Zero | Zero | Zero | Zero | 2 | 2 |
| Surface Resistivity (Ω/sq) | $1.2 \times 10^{11}$ | $8.7 \times 10^{9}$ | $2.3 \times 10^{9}$ | $3.5 \times 10^{8}$ | $2.4 \times 10^{10}$ | $2.8 \times 10^{9}$ |

The colloidal silica used was that sold by Monsanto Ltd., as Syton X 30 which has a mean particle size of about 25 mμ.

EXAMPLE VI

This example illustrates the use of a particulate silica in a backcoat composition containing a synthetic hectorite clay.

A photographic base paper of substance 180 g/m² was coated on both surfaces with an extruded polyethylene film of substance 38 g/m². Various backcoat compositions were then applied at a wet coatweight of about 12 g/m² and surface resistivity measurements were made when dry using a megohmeter. The backcoated surface then assessed for pencil and other "take" (the later includes fountain pen ink, ballpoint pen ink and wax crayon) and for resistance to washoff by photographic processing solutions. The results are given in Table VI below. Each backcoating composition also contained 0.04% of Manoxol OT wetting agent, sold be Hardman & Holden Ltd. Figures are also given which illustrate the effect of particulate silica alone. The particulate silica used was that sold by Joseph Crosfield & Sons Ltd., as Gasil 200, which has mean particle size of about 9μ.

Table VI

| Coating Mix Composition | | Properties of Coated Polymer Coated Photobase | | | | |
|---|---|---|---|---|---|---|
| % Laponite S | % Gasil 200 | Pencil take | Other take | Pencil Washoff Resistance | Other Washoff Resistance | Surface Resistivity Ω/sq |
| 1.0 | — | Poor to Mod. | Good | Good | Fair | $1.2 \times 10^{10}$ |
| 1.0 | 0.1 | Poor | Good | Good | Fair to Good | $1.0 \times 10^{10}$ |
| 1.0 | 0.5 | Poor | Good | Moderate | Fair | $7.4 \times 10^{9}$ |
| 1.0 | 1.0 | Poor to Mod. | Good | Good | Fair to Good | $2.0 \times 10^{10}$ |
| 1.0 | 5.0 | Moderate | Good | Good | Fair to Good | $7.0 \times 10^{9}$ |
| 5.0 | — | Poor | Good | Moderate | Mod. to Fair | $4.9 \times 10^{8}$ |
| 5.0 | 0.1 | Poor | Good | Moderate | Fair | $3.4 \times 10^{8}$ |
| 5.0 | 0.5 | Poor to Mod. | Good | Fair | Mod. to Fair | $3.0 \times 10^{8}$ |
| 5.0 | 1.0 | Poor to Mod. | Good | Fair | Poor to Mod. | $2.8 \times 10^{8}$ |
| 5.0 | 5.0 | Fair | Good | Fair | Poor to Mod. | $1.5 \times 10^{8}$ |
| — | 0.1 | Poor | Good | Fair | Good | $7.0 \times 10^{13}$ |
| — | 0.5 | Poor | Good | Good | Good | $1.2 \times 10^{14}$ |
| — | 1.0 | Fair | Good | Good | Good | $2.2 \times 10^{14}$ |
| — | 5.0 | Fair | Good | Fair | Good | $9.0 \times 10^{14}$ |

EXAMPLE VII

This Example illustrates the use of a colloidal silica in a backcoat composition containing a synthetic hectorite clay.

A photographic base paper of substance 180 g/m$^2$ was coated on both surfaces with an extruded polyethylene film of substance 38 g/m$^2$. Various backcoat compositions were then applied at a wet coatweight of about 12 g/m$^2$ and surface resistivity measurements were made when dry using a megohmeter. The backcoated surface was then assessed for pencil and other "take" and for resistance to washoff by photographic processing solutions. The resuts are given in Table VII below. Figures are also given which illustrate the effect of colloidal silica alone. Each backcoating composition also contained 0.04% of Manoxol OT wetting agent.

Table VII

| Composition of Backcoat Mix | | Properties of Coated Polymer Coated Photobase | | | | |
|---|---|---|---|---|---|---|
| % Laponite S | % Syton X 30 | Pencil Take | Other Take | Pencil Washoff | Other Washoff | Surface Resistivity Ω/sq |
| 1.0 | — | Poor to Mod | Good | Good | Fair | $1.2 \times 10^{11}$ |
| 1.0 | 0.3 | Poor to Mod | Good | Fair | Fair | $1.2 \times 10^{10}$ |
| 1.0 | 0.15 | Poor | Good | Fair | Fair | $2.3 \times 10^{10}$ |
| 1.0 | 0.3 | Fair | Good | Good | Fair to Good | $2.0 \times 10^{10}$ |
| 1.0 | 0.6 | Poor to Mod | Good | Fair | Fair | $2.7 \times 10^{10}$ |
| 1.0 | 1.05 | Poor | Good | Fair | Fair | $6.4 \times 10^{10}$ |
| 1.0 | 1.5 | Poor | Good | Moderate | Fair to Mod | $1.8 \times 10^{10}$ |
| 5.0 | — | Poor | Good | Moderate | Mod to Fair | $4.9 \times 10^{8}$ |
| 5.0 | 0.15 | Poor to Mod | Good | Fair | Moderate | $5.5 \times 10^{8}$ |
| 5.0 | 0.3 | Poor to Mod | Good | Poor to Mod | Poor | $3.8 \times 10^{8}$ |
| 5.0 | 0.6 | Poor to Mod | Good | Poor to Mod | Mod to Fair | $4.7 \times 10^{8}$ |
| 5.0 | 1.05 | Moderate | Good | Fair | Poor to Mod | $4.1 \times 10^{8}$ |
| 5.0 | 1.5 | Fair | Good | Moderate | Moderate | $4.5 \times 10^{8}$ |
| — | 0.15 | Poor | Good | Good | Fair | $1.7 \times 10^{12}$ |
| — | 0.30 | Poor | Good | Good | Fair | $1.2 \times 10^{12}$ |
| — | 0.60 | Poor | Good | Good | Good | $1.1 \times 10^{12}$ |
| — | 1.05 | Poor | Good | Fair | Good | $2.0 \times 10^{13}$ |
| — | 1.50 | Moderate | Good | Good | Fair | $7.5 \times 10^{13}$ |

EXAMPLE VIII

This Example illustrates the use of a colloidal and a particulate silica in a backcoat composition containing a synthetic hectorite clay.

A photographic base paper of substance 180 g/m$^2$ was coated on both surfaces with an extruded polyethylene film of substance 38 g/m$^2$. Various backcoat compositions were then applied at a wet coatweight of about 20 g/m$^2$ using a plain Meyer Rod bar and surface resistivity measurements were made when dry using a megohmeter. The backcoated surface was then assessed for pencil and other take and for resistance to washoff by photographic processing solutions. The results are given in Table VIII below. Each backcoating composition also contained 0.04% Manoxol OT wetting agent.

TABLE VIII

| Backcoat Mix Composition | | | Take | | Washoff | | |
|---|---|---|---|---|---|---|---|
| % Laponite Gasil S | % Syton 200 | % Pencil X 30 | Other Take | Washoff Take | Pencil Washoff Resistance | Other Resistivity Resistance | Surface Ω/sq |
| 1 | 1 | 2 | Poor to Mod. | Good | Mod. | Good to Mod. | $2.3 \times 10^{10}$ |
| 2 | 2 | 4 | Good | Good | Good | Fair to Good | $9.3 \times 10^{9}$ |

TABLE VIII-continued

| Backcoat Mix Composition | | | Take | | Washoff | | |
|---|---|---|---|---|---|---|---|
| % Laponite Gasil S | % Syton 200 | % Pencil X 30 | Other Take | Washoff Take | Pencil Washoff Resistance | Other Resistivity Resistance | Surface Ω/sq |
| 4 | 2 | 2 | Fair | Good | Poor | Mod. to Poor | $3.5 \times 10^8$ |
| 5 | 5 | — | Fair | Good | Fair | Poor to Mod. | $1.5 \times 10^8$ |

What I claim is:

1. A photographic sheet material element, adapted for carrying a radiation-sensitive layer for receiving a photographic image, which comprises a support having incorporated therewith an antistatic additive composition as a sizing or a backcoat, said antistatic additive composition comprising synthetic hectorite clay having a layered structure, the layers of which are electrically charged and said layers being magnesium silicate lattice structure in which magnesium ions are bound in octadhedral relationship with hydroxyl ions.

2. In a photographic sheet material element as defined in claim 1 wherein said support is paper and said antistatic additive composition is present as a size coat on said paper.

3. In a photographic element as defined in claim 2 wherein said support is paper having a layer of polyolefin available for carrying a radiation-sensitive layer for receiving a photographic image.

4. In a photographic element as defined in claim 3 wherein said polyolefin is polyethylene.

5. In a photographic element as defined in claim 1 wherein said support comprises a sheet of paper having a layer of polyolefin on each side thereof.

6. In a photographic element as defined in claim 5 wherein one of said layers of polyolefin has, in turn, a layer of said antistatic additive composition thereon, the remaining layer being available for carrying a radiation-sensitive layer for receiving a photographic image.

7. In a photographic element as defined in claim 2 wherein said size also contains sodium sulfate.

8. In a photographic element as defined in claim 6 wherein said antistatic additive composition also contains sodium sulfate.

9. In a photographic element as defined in claim 6 wherein said antistatic layer also contains particulate silica.

10. In a photographic element as defined in claim 6 wherein said polyolefin is polyethylene.

* * * * *

UNITED STATES PATENT OFFICE

CERTIFICATE OF CORRECTION

PATENT NO. : 4,173,480

DATED : November 6, 1979

INVENTOR(S) : Woodward, Antony I.

It is certified that error appears in the above-identified patent and that said Letters Patent column 4, line 56, change "are" to --was--;

Table III, numerical column 1 thereof, change "½" to --¼--;

Table III, numerical column 5 thereof, change "$2.8 \times 10^{10}$" to --$2.9 \times 10^{10}$--; and Table VIII, change subheadings in columns 8 and 9 from

| " % Laponite Gasil S | % Syton 200 | % Pencil X 30 | Other Take | Washoff Take | Pencil Washoff Resistance | Other Resistivity Resistance | Surface Ω/sq" |
|---|---|---|---|---|---|---|---|

to

| --% Laponite S | % Gasil 200 | % Syton X 300 | Pencil Take | Other Take | Pencil Washoff Resistance | Other Washoff Resistance | Surface Resistivity Ω/sq |
|---|---|---|---|---|---|---|---|

Signed and Sealed this

*Twenty-second* Day of *April 1980*

[SEAL]

*Attest:*

SIDNEY A. DIAMOND

*Attesting Officer*

*Commissioner of Patents and Trademarks*